United States Patent [19]

Lynch

[11] 4,163,042

[45] Jul. 31, 1979

[54] CONTAINERS FOR CATALYSTS FOR EXHAUST EMISSION CONTROL

[75] Inventor: John H. Lynch, St. Annes-on-Sea, England

[73] Assignee: T.I. Silencer Services Limited, Lancashire, England

[21] Appl. No.: 433,371

[22] Filed: Jan. 14, 1974

[30] Foreign Application Priority Data

Jan. 13, 1973 [GB] United Kingdom ..... 1879/73
Aug. 3, 1973 [GB] United Kingdom ..... 37064/73

[51] Int. Cl.[2] ..... B01J 8/00; F01N 3/15

[52] U.S. Cl. ..... 422/179; 29/157 R; 138/112

[58] Field of Search ..... 25/288 FC; 60/299, 295; 138/112; 422/179, 180; 29/157 R

[56] References Cited

U.S. PATENT DOCUMENTS

| | | | |
|---|---|---|---|
| 3,172,251 | 3/1965 | Johnson | 23/288 F |
| 3,211,534 | 10/1965 | Rideway | 23/288 FC |
| 3,247,665 | 4/1966 | Behrens | 23/288 FC |
| 3,441,381 | 4/1969 | Keith et al. | 23/288 FC |
| 3,441,382 | 4/1969 | Keith et al. | 23/288 FC |
| 3,597,165 | 8/1971 | Keith et al. | 23/288 FC |
| 3,692,497 | 9/1972 | Keith et al. | 23/288 FC |
| 3,741,287 | 6/1973 | Mittman | 29/451 X |
| 3,771,967 | 11/1973 | Nowak | 23/288 FC |
| 3,787,944 | 1/1974 | Mittman | 29/451 X |
| 3,798,006 | 3/1974 | Balluff | 23/288 FC |

FOREIGN PATENT DOCUMENTS

| | | | |
|---|---|---|---|
| 791117 | 7/1968 | Canada | 23/288FC |

*Primary Examiner*—Barry S. Richman
*Attorney, Agent, or Firm*—Scrivener, Parker, Scrivener & Clarke

[57] ABSTRACT

In a container assembly for an exhaust emission control catalyst for internal combustion engines, of the kind comprising a cylindrical substrate body carrying the catalyst and mounted within a sheet metal casing with the interposition of a compressible cushioning layer of refractory material, an open-seam sheet metal shroud of variable circumference is used to enclose the compressible layer and to compress it prior to, or simultaneously with, endwise insertion into the casing. The shroud or the casing may have elongated ribs pressed in it, the ribs tapering at their ends to facilitate entry.

5 Claims, 6 Drawing Figures

CONTAINERS FOR CATALYSTS FOR EXHAUST EMISSION CONTROL

This invention relates to a construction for a container for a catalyst for the control of exhaust emission of internal combustion engines, as well as to a method of assembling the catalyst into the container. Such exhaust emission control is required primarily on the engines of motor vehicles, but could be applied also to other internal combustion engines.

It is known to insert in the exhaust system of the engine a hollow cylindrical sheet metal casing similar to that of a silencer but containing a porous substrate on which is deposited a catalyst that promotes the oxidation or decomposition of harmful emissions in the exhaust gases.

At first sight it may appear to be a simple matter to mount an appropriate size and shape of substrate in a suitable casing. However this is far from the truth and in practice there are substantial problems. Primarily there is the fact that the substrate is generally of ceramic material and, being necessarily porous, is structurally weak so it must be shielded from shocks which could fracture it; yet it cannot be mounted rigidly in the casing because of differential thermal expansion between the material of the substrate and the metal of the casing. Moreover, any mounting that allows relative movement between the substrate and components which locate it will lead to trouble through abrasion of the fragile material of the substrate. A further desirable feature is that there should be at least some degree of thermal insulation in order to keep the catalyst at its working temperature and to reduce the radiation of heat to adjacent parts of the vehicle.

Constructions have already been proposed to meet some or all of these objectives. For example in British Patent Specification No. 1,052,106 of Engelhard Industries Inc, there is disclosed an arrangement in which the sides of the substrate other than its inlet and outlet faces are enclosed in a frame of gas-impervious heat-insulating layers and the resulting body is engaged on two sides by metal plates which press it to one side of the surrounding casing by the use of springs or screws or both. Such an arrangement is based on the substrate being of rectangular cross-section, which is not convenient for manufacture, and it may create problems of leakage of exhaust gases between adjacent corners of the heat-insulating layers, which necessarily have to have some clearance to allow for the differential thermal expansion. That the patentees are aware of such problems is shown by their later Patent Specification No. 1,146,736 in which there is disclosed a cylindrical casing having frusto-conical ends and containing a cylindrical porous ceramic substrate or element located between flanges in the casing. The cylindrical surface of the element is coated with a fibrous aluminium silicate cement to close its pores to serve as a protective coating or padding. The resulting body is then enclosed in a corrugated member, either of corrugated metal sheet or preferably of corrugated knitted mesh metallic fabric which fills the narrow annular space between the body and the casing.

We believe that even this proposal does not answer all the problems. Again, the patentees acknowledge in a U.S. Pat. No. 3,692,497 of still later date, that there may ultimately be some movement of the substrate, possibly by rotation about its axis, with respect to the casing, leading to abrasion and consequent damage. They therefore propose to provide an inwardly projecting tongue or protrusion on the casing to prevent this.

As far as we are aware, none of the prior proposals has given consideration to the problems of assembly of the materials into the casing. In particular where the casing is cylindrical and in one piece and where there is a knitted mesh or other pressible layer between the substrate and the casing, it is almost impossible, by known methods, to ensure assembly with the required degree of grip applied to the substrate by the compressible layer, and with the layer evenly distributed.

Attempts have even been made to wrap the outer casing around the substrate and the compressible layer under a predetermined load, then to weld its seam, and although this is possible and produces an acceptable product, it is expensive to carry out. Moreover the diameter of the casing then varies with any variations in the diameter of the substrate within its tolerances limits, and it is therefore necessary to provide a range of different sizes of end cones or end plates and fit them selectively according to the size of the casing. This adds further to the cost of manufacture. Finally this wrapping method is only applicable to containers of round cross-section.

The primary aim of the present invention is to ensure firm location of the substrate with a degree of pressure which can be predetermined and which can be maintained consistently and economically under production conditions, and which moreover is maintained throughout the useful life of the catalyst. A further aim is to provide a construction which facilitates assembly under production conditions.

According to the invention there is proposed a container assembly for an exhaust emission control catalyst in which a cylindrical substrate body carrying the catalyst and designed for exhaust gas flow from one end face to the other is enclosed over its cylindrical surface in a compressible cushioning layer of a refractory, metallic or composite nature, and this cushioning layer is in its turn enclosed in an open-seam one-piece or multipiece cylindrical shroud or sleeve which, by virtue of the open-seam, is variable in circumference and is compressed around the cushioning layer, the shroud or sleeve fitting into a cylindrical sheet metal casing.

Here we use the term 'cylindrical' in its true and broad sense as meaning a shape of any curved cross-section, circular, elliptical, oval or even nearly rectangular, but of substantially uniform cross-section along its length.

The use of a shroud or sleeve to enclose and compress the cushioning layer allows the layer to be compressed substantially uniformly over the entire surface of the substrate as the substrate is inserted into the casing, which is of fixed diameter.

The shroud or sleeve is preferably of sheet metal and may be in one piece, with its edges simply overlapping.

Preferably, according to a further optional feature of the invention, longitudinally extending ribs are formed in the shroud or sleeve, or in the material of the casing to space the main body of the sleeve or shroud away from the casing. This gives a substantial additional degree of thermal insulation over and above that given by the cushioning layer. The ribs are, according to a still further feature of the invention, tapered to nothing at one end so as to facilitate entry of the shroud or sleeve into the casing.

Preferably there are end rings, likewise of refractory, metallic or composite material similar to the cushioning layer, at each end of the casing to locate the substrate axially and hold it firmly without abrading it.

Also according to the invention there is proposed a method of constructing a container assembly for an exhaust emission control catalyst comprising enclosing a cylindrical catalyst-bearing substrate in a compressible cushioning layer of a refractory, metallic or composite nature, so that the layer encloses the cylindrical surface of the substrate, placing the resulting body in an open-seam cylindrical shroud or sleeve, applying external pressure to the shroud or sleeve to cause it to contract circumferentially and thereby to squeeze the compressible layer to a predetermined degree, and then sliding the resulting compressed assembly axially into a cylindrical sheet metal casing of fixed circumferential dimensions.

Preferably the axial force required to slide the assembly into the casing is applied to the shroud or sleeve. This is an important advantage of the presence of the shroud or sleeve according to the invention, in that it protects the substrate from damage and from contamination during this assembly step.

The invention will now be further described by way of example with reference to the accompanying drawings, in which.

Figure 1:
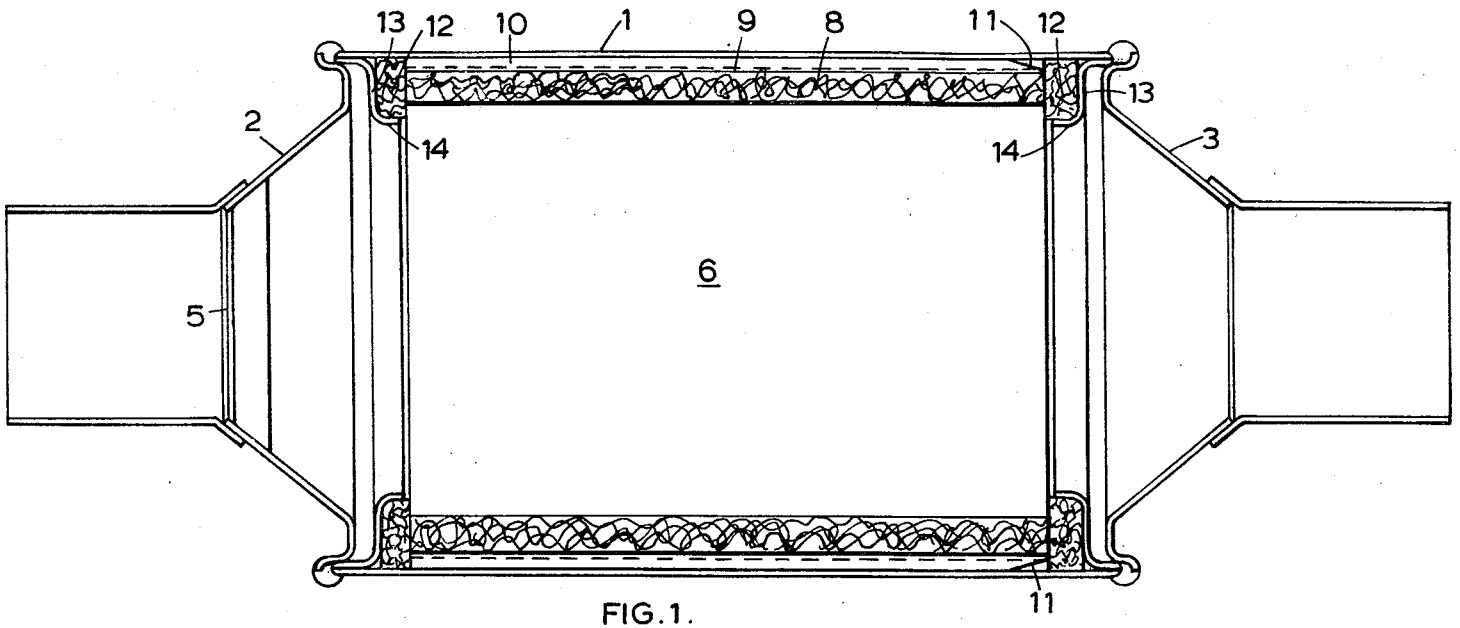
FIG. 1 is a cross-section through a catalyst container according to the invention, taken in a plane containing its axis.
Figure 2:
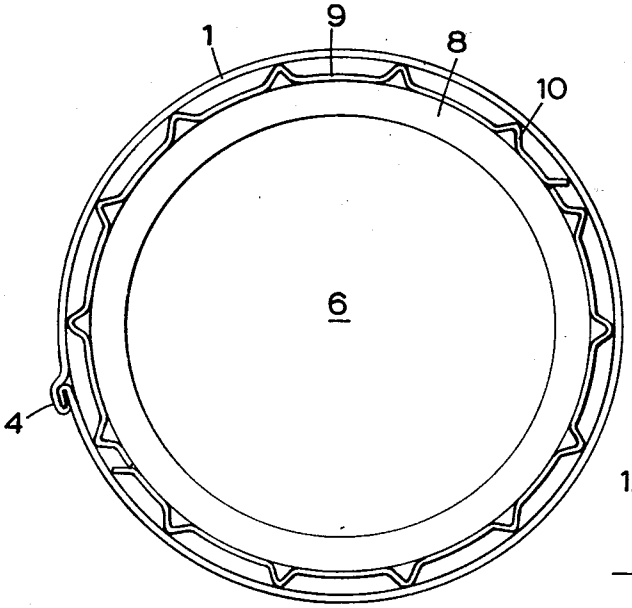
FIG. 2 is a cross-section taken in a plane perpendicular to the axis.

We refer first to FIGS. 1 and 2. The container is made up of an outer cylindrical casing 1 of circular cross-section and frusto-conical inlet and outlet shells 2 and 3, terminating in cylindrical connecting portions. As mentioned earlier, the casing need not be circular in cross-section, but could be elliptical, oval, or even nearly rectangular, although with at least slightly rounded corners. The casing 1 in the example shown is made from a single sheet of stainless steel 1.25 mm thick, rolled around and having its meeting edges joined by a lock seam 4 (FIG. 2). The inlet and outlet shells are identical except that the inlet shell 2 contains a bar 5 extending diametrically across its interior. This bar is of Vee cross-section, with its apex upstream and it serves as a diffuser, to spread the flow of incoming hot exhaust gases and thereby to reduce or eliminate the danger of erosion of the centre of the inlet face of the catalyst carrying substrate.

The substrate is shown at 6. It is a cylindrical body corresponding in cross-section to the casing 1 and of a known kind, comprising a porous refractory ceramic material. Again, as in known designs, its cylindrical surface is coated with a thin layer 7 of a pasty refractory fibrous material such as that sold under the Registered Trade Mark 'Fiberfax'.

Around the substrate 6 there is a cushioning layer 8 made up of two layers of a commerically available knitted metallic wire mesh, preferably made from stainless steel wire such as that sold under the Registered Trade Mark 'Incoloy DS'. This cushioning layer 8 is compressible and is porous; by virtue of its open nature it also gives a substantial degree of heat insulation.

Around the cushioning layer 8 is a sheet metal shroud or sleeve 9 which is the key to the invention. In the example shown it is made up of two half-cylindrical shells with their mating edges overlapping. A number of outwardly projecting ribs or swages 10 are pressed in the shell, evenly spaced apart and extending parallel to the axis of the assembly. The shroud 9 is made of stainless steel sheet of 22 S.W.G. (0.75 mm thick) and so the material is sufficiently rigid to have no significant inherent cushioning effect, in that the ribs will not yield under the sort of loadings involved in the assembly under discussion. But by virtue of the open nature of the seams or overlaps between the shells the shroud 9 is free to alter its circumference under externally applied loading and is therefore free, although substantially rigid in itself, to apply an even and substantially uniform compression to the cushioning layer 8.

When the shroud 9 is fitted around the layer 8 and then squeezed to compress that layer and thereby grip the substrate evenly and firmly, the resulting assembly can be slid axially into the casing 1. This is facilitated by the fact that the ribs 10 taper to nothing at one end of the shroud, as shown at 11 in FIG. 1. When the shroud is in place the ribs 10 only make line contact with the inside of the casing 1 and so there is a substantial degree of thermal insulation. In a modification the ribs could be inwardly directed ribs formed on the casing 1 instead of outward ribs 10 on the shroud 1 and the result would be the same.

In a further modification the knitted metal mesh cushioning layer could be replaced by a cushioning layer of fibrous refractory material, or a composite refractory and metallic material.

The substrate 6 is located axially by pre-formed end rings 12 of compressible material, in fact of the same knitted metal mesh as the cushioning layer 8. These in their turn are located by pressed sheet metal baffles 13 which each include a lip 14 to extend over the inside of the associated ring 12 and substantially prevent there being a path for the exhaust gases through the metal mesh cushioning members. However the lips 14 do not touch the substrate 6 itself.

Figure 3:
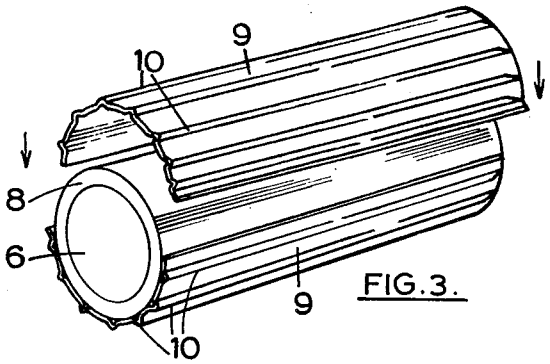
FIG. 3 is an isometric view illustrating a step in the assembly.

To assemble the entire unit, first one half of the shroud 9 is laid in a jig. The substrate 6, already with its impervious coating 7 and with the cushioning layer around it, is laid in this half and then the other half shroud is placed on top. This is indicated in FIG. 3. Alternatively the cushioning layer may likewise be in two semi-cylindrical halves, of which one is placed in the lower shroud half, followed by the coated substrate and then by the other half, and finally by the other section of the shroud.

Figure 4:
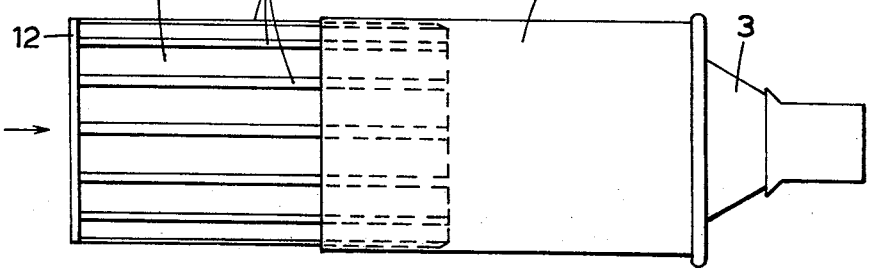
FIG. 4 is a diagrammatic view showing a further step in the assembly.

The casing 1 can already have on it the one endshell 3, metal baffle 13 and cushioning end ring 12. The assembly described in the previous paragraph is slid axially into the other end of the casing 1, with the tapered ends 11 of the ribs 10 entering first, as shown in FIG. 4. To allow the assembly to enter, the shroud has to be squeezed to compress the cushioning layer 8. It will be understood that the degree of compression applied can be predetermined by careful selection of the thickness of the cushioning member and the height of the ribs 10 in relation to the outside diameter of the substrate 6 and the diameter of the casing 1.

Then the other end ring 12 and baffle 13 and the inlet shell 2 can be fitted. Preferably, however, the end ring 12 and baffle 13 are used to transmit the axial force with which the assembly is pushed into the casing. For example the baffle and end ring are fitted onto a die on the free end of a ram used to provide the force. It will be appreciated that this force is transmitted directly to the shroud 9 and so there is no significant axial crushing load on the fragile material of the substrate.

In the example illustrated the element 6 has a diameter of 102.5 mm. The inside diameter of the casing 1 is 117.5 mm. The shroud 9 has ribs 10 which are 3 mm high. The cushioning layer 8 is 7 mm thick in its uncompressed condition so the maximum diameter of the shroud assembly before insertion is about 123 mm. This is compressed down to 117.5 mm on insertion into the casing 1, all of the compression taking place in the layer 8, which is then only about 4 mm thick. By virtue of the manner of compression by the shroud 9, the layer 8 grips the substrate 6 firmly and without abrasion or risk of fracture, and there is sufficient residual compressive stress to maintain that grip under all thermal conditions and mechanical shocks likely to be encountered.

It is to be noted that the shroud itself is not radially compressed to any appreciable extent but simply contracts by overlap of its edges. Thus it is the cushioning layer, not the shroud, that takes up manufacturing tolerances and maintains the grip on the substrate. The functions of the shroud are to apply even compression to the cushion to facilitate assembly into the casing and to define the heat insulating air gap.

Also it should be noted that during assembly the shroud only compresses the cushion the exact minimum amount necessary to fit into the casing. There is no question of compressing down to an undersize value and then relying on the resilience of the cushion to ensure a tight and vibration-free fit in the casing.

Figure 5:
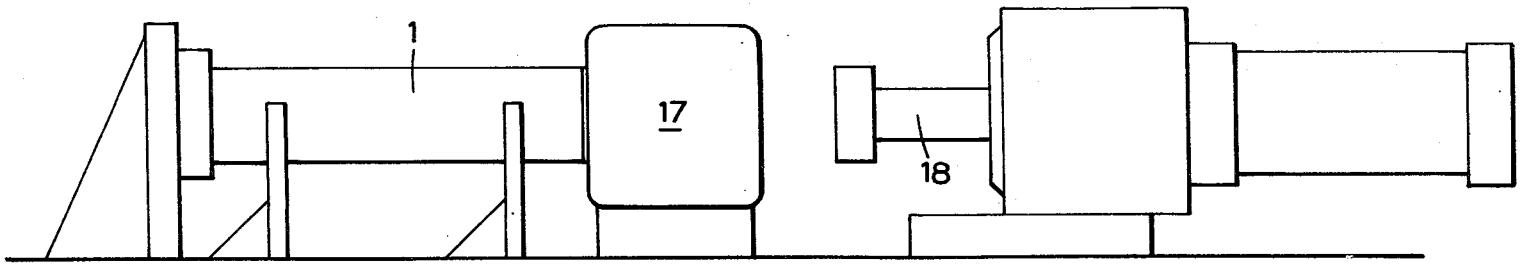
FIG. 5 is an illustration of a machine suitable for performing the assembly.
Figure 6:
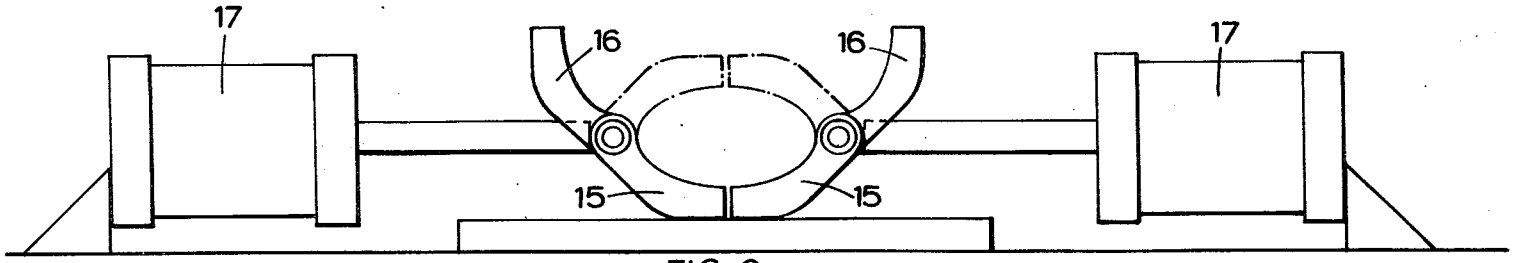
FIG. 6 is another view of part of the same machine, looking along its axis.

FIGS. 5 and 6 show apparatus suitable for performing the insertion step; in this case the casing has an oval cross-section. The lower half of the shroud is placed by hand in a trough formed by the lower halves of a cooperating pair of jaws 15 (FIG. 6). This is followed by the cushioned substrate and then by the other half of the shroud. Top halves 16 of the jaws are then caused by opposed pneumatic rams 17 to swing down to compress the assembly, down to the desired final dimensions, whereupon an end ring and baffle are fitted onto the end of a ram 18, (FIG. 5) which is pneumatically actuated to cause the end ring and baffle to engage the shrouded and pre-compressed assembly and push it into an appropriately placed casing, which already contains the other end ring and baffle and has one end shell 3 on it.

The resultant assembly is then removed from the apparatus and the remaining end shell 2 is welded in place, simultaneously with the adjacent baffle 13.

I claim:

1. A container assembly for an exhaust emission control catalyst comprising a cylindrical substrate body carrying said catalyst and having a cylindrical surface and two end faces designed for exhaust gas flow from one of said end faces to the other, a compressible resilient cushioning layer surrounding the cylindrical surface of said body, an open-seam sheet metal shroud surrounding said cushioning layer, said shroud, by virtue of the open seam, being of variable circumference and being thereby compressible around said cushioning layer, said shroud having formed in the wall thereof a plurality of outwardly projecting circumferentially spaced ribs, and a cylindrical sheet metal casing of fixed circumferential dimensions, in which said substrate, enclosed in said cushioning layer and said shroud, is received, with said ribs on said shroud making line contact with the inner surface of said casing and the remainder of said shroud being spaced away from said casing, the circumferential dimensions of said casing being such that said cushioning layer is under compression by the action of said shroud.

2. The container assembly set forth in claim 1 wherein said shroud comprises two semi-cylindrical halves.

3. The container assembly set forth in claim 1 wherein said ribs extend longitudinally parallel to the axis of said substrate and are circumferentially spaced apart.

4. The container assembly set forth in claim 3 wherein said ribs taper to nothing at one end of said shroud.

5. A method of assembling a cylindrical body of a monolithic substrate carrying an exhaust emission control catalyst into a cylindrical housing of fixed circumferential dimension comprising the steps of wrapping a resilient cushioning layer around the cylindrical surface of said body, enclosing the wrapped cushioning layer in an open-seam sheet metal substantially cylindrical shroud, said shroud being of variable circumferential extent by virtue of said open-seam and said shroud having formed thereon a plurality of circumferentially spaced outwardly projecting longitudinally extending ribs, each of said ribs tapering to zero at one end of said shroud, the housing and layer of cushioning material being selected that the resulting assembly of said substrate body, layer of cushioning material and shroud has a greater circumferential dimension than said housing, squeezing said shroud such as to compress said cushioning layer until the circumferential dimension of said shroud at least at the end where the ribs taper to zero is less than the circumferential dimension of said housing, inserting said end into said housing, and thereafter exerting an axial force on said assembly until it comes to rest within said housing with said ribs resiliently urged into line contact with the inner surface of said housing by the resilience of said cushioning layer.

* * * * *